United States Patent [19]

Kojima

[11] Patent Number: 4,673,360

[45] Date of Patent: Jun. 16, 1987

[54] BUILT-IN TANK CONTAINING LUBRICANT OR THE LIKE FOR OUTBOARD MOTORS

[75] Inventor: Akinori Kojima, Hamamatsu, Japan

[73] Assignee: Sanshin Kogyo Kabushiki Kaisha, Hamamatsu, Japan

[21] Appl. No.: 841,683

[22] Filed: Mar. 21, 1986

Related U.S. Application Data

[63] Continuation of Ser. No. 629,347, Jul. 10, 1984, abandoned.

[30] Foreign Application Priority Data

Jul. 21, 1983 [JP] Japan ..... 58-131854

[51] Int. Cl.[4] ..... B36B 35/00

[52] U.S. Cl. ..... 440/88; 123/195 P

[58] Field of Search ..... 440/76, 77, 88; 123/195 P, 196 R, 196 S

[56] References Cited

U.S. PATENT DOCUMENTS

| | | | |
|---|---|---|---|
| 2,691,954 | 10/1954 | Shively | 440/88 |
| 2,969,763 | 1/1961 | Foster | 440/88 |
| 3,043,260 | 7/1962 | Tank | 440/88 |
| 3,115,114 | 12/1963 | Rapplean | 440/88 |
| 3,500,786 | 3/1970 | Oliver | 440/88 |
| 4,160,425 | 7/1979 | Curtis | 440/88 |

FOREIGN PATENT DOCUMENTS 56-55101 12/1981 Japan .

*Primary Examiner*—Joseph F. Peters, Jr.
*Assistant Examiner*—C. T. Bartz
*Attorney, Agent, or Firm*—Ernest A. Beutler

[57] ABSTRACT

A lubricant tank arrangement for an outboard motor wherein the lubricant tank is contained within the protective cowling of the power head but its closure cap is accessible directly through the protective cowling. The closure cap is recessed and a sleeve is slidably supported in the neck and is movable between a retracted position and an extended position so as to facilitate filling. An improved sealing arrangement is also incorporated between the cowling and the filler neck so as to prevent the ingress of foreign materials into the interior or the protective cowling through the opening which affords access to the filler neck.

7 Claims, 4 Drawing Figures

BUILT-IN TANK CONTAINING LUBRICANT OR THE LIKE FOR OUTBOARD MOTORS

This application is a continuation of application Ser. No. 629,347, filed July 10, 1984, now abandoned.

BACKGROUND OF THE INVENTION

This invention relates to a built-in tank containing lubricant or the like for outboard motors and more particularly to an improved filler neck and closure construction for a container.

As is well know, most outboard motors employ two-cycle internal combustion engines as their power sources. Although two-cycle engines have many advantages, the necessity of mixing fuel and lubricant to lubricate such engines of the conventional type can be bothersome and can result in inadequate lubrication under some circumstances and over-lubrication under other circumstances. In order to avoid some of these difficulties, it has been proposed to provide a separate lubricating system for two-cycle engines in wich lubricant is supplied to the engine separately from a lubricant storage tank. Such a system is shown in U.S. Pat. No. 4,372,258, issued Feb. 8, 1983, entitled "Lubricating System For Outboard Engine" and an application for U.S. Ser. No. 528,996, filed Sept. 2, 1983, entitled "Outboard Engine" now Patent No. 4,493,661 issued 1/15/85 and assigned to the assignee of this application. As is noted in the identified patent and application, it is desirable to position the lubricant tank within the cowling of the outboard motor so that lubricant may be readily added to it. If the lubricant tank is mounted within the outer cowling, it is desirable to provide an arrangement wherein lubricant may be conveniently added. This can be greatly facilitates if the filler neck for the lubricant tank is readily accessible from the outer cowling such as if the filler neck and cap for the lubricant tank are positioned externally of the cowling. However, such external positioning presents certain difficulties. For example, if the filler neck and cap extend beyond the outer cowling, they are likely to cause an obstruction and, furthermore, could be damaged inadvertently. On the other hand, if the filler neck and cap are positioned in a substantially flush relationship with the outer cowling, there is a difficulty in refilling the tank.

It is, therefore, a principal object of this invention to provide an improved filler arrangement for a lubricant tank.

It is another object of the invention to provide a filler arrangement for a tank of an outboard motor that is not exposed and yet which is easily used.

It is a further object of this invention to provide a filler arrangement for a lubricant tank in which an integral filling device is incorporated which need not be operated independently by the user.

Although the flush mounting of the filler neck and closure cap for a tank in an outboard motor has a numer of advantages, there must be access given to the operator's hands so as to remove the cap. If sufficient clearance is left, however, there will be an opening through which water and other foreign matter may enter to contaminate the components contained within the outer cowling.

It is, therefore, a still further object of this invention to provide an improved filler arrangement for a cowling surrounded tank.

It is another object of this invention to provide and improved filler arrangement for the tank of an outboard motor having an accessible flush mounting and effective sealing.

SUMMARY OF THE INVENTION

A first feature of this invention is adapted to be embodied in a filler arrangement for a lubricant tank or the like comprising a neck adapted to receive a closure cap. A sleeve is slidably supported within the neck for movement between a retracted position in which the sleeve does not extend substantially beyond the upper end of the neck and an extended position in which the outer end of the sleeve extends beyond the neck to assist in filling the tank. Means are provided for retaining the sleeve relative to the neck for movement between its positions.

Another feature of the invention is adapted to be embodied in an outboard motor having a power head containing an internal combustion engine, a protective cowling encircling the engine and a fluid tank contained within the protective cowling and having a filler neck terminating substantially flush with an outer surface of the protective cowling. In accordance with the invention, a sleeve is slidably supported within the neck for movement between a retracted position in which the sleeve does not extend substantially behond the upper end of the neck or the surface of the protective cowling and an extended position in which the outer end of the sleeve extends above the protective cowling surface to assist in filling the tank.

Another feature of the invention is also adapted to be embodied in an outboard motor having a power head containing an internal combustion engine, a protective cowling encircling the engine and a fluid tank contained within the power head and having a filling neck terminating substantially flush with the outer surface of the protective cowling. In accordance with this feature of the invention, the outer cowling defines an opening that is spaced around the filler neck and sealing means are carried by the filler neck and the portion of the outer cowling defining the opening for defining a closed seal and for permitting removal of the outer cowling without removal of the filler neck.

Yet a further feature of the invention is also adapted to be embodied in an outboard motor having a construction as described in the preceding paragraph. In accordance with this feature of the invention, a closure cap is received on the neck and the outer cowling supports resilient seal means which engage the closure cap below its upper end and which provide a seal around the opening through which the closure cap is accessible.

DETAILED DESCRIPTION OF THE PREFERRED EMBODIMENTS

Figure 1:
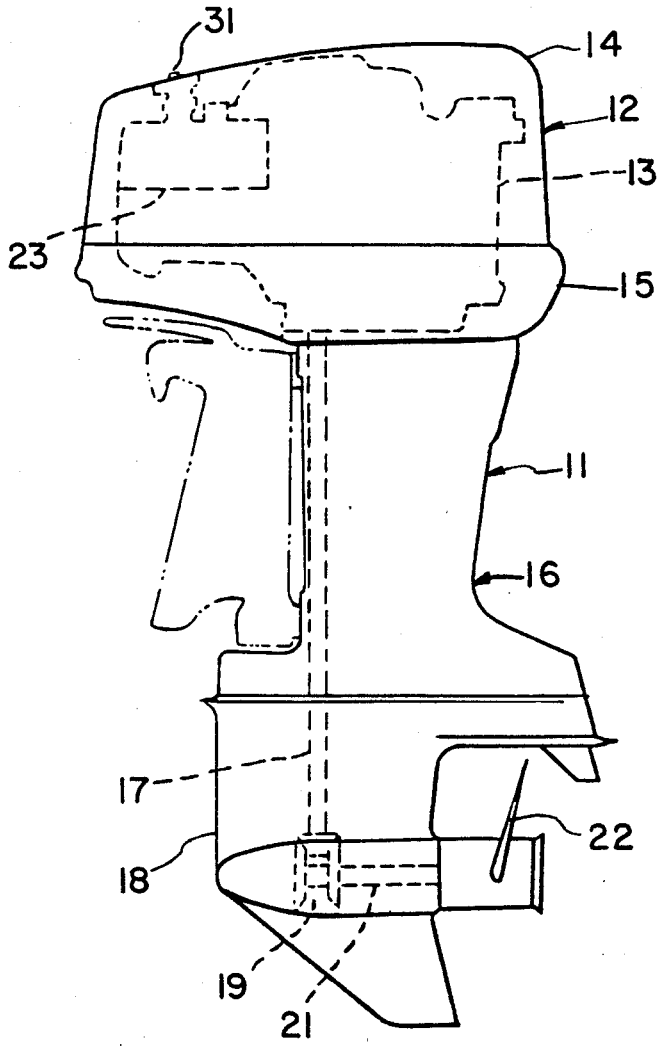
FIG. 1 is a side elevational view of an outboard motor constructed in accordance with an embodiment of the invention.

Referring first to FIG. 1, an outboard motor constructed in accordance with an embodiment of the invention is identified generally by the reference numeral 11, The outboard motor 11 includes a power head, indicated generally by the reference numeral 12, which consists of an internal combustion engine 13 of the two-cycle type and which is surrounded by a protective cowling consisting of a cover member 14 and a lower tray 15. A dirve shaft housing, indicated generally by the reference numeral 16, depends from the power head 12 and contains a drive shaft 17 that is driven by the output shaft of the engine 13 in a known manner. The drive shaft 17 terminates within a lower unit 18, which is affixed to the lower end of the drive shaft housing. The drive shaft 17 drives a forward, neutral, reverse transmission 19 which is contained within the lower unit 18 and which may be of any known type. The transmission 19 is adapted to drive a propeller shaft 21 to which a propeller 22 is affixed for driving the associated watercraft. The construction thus far described may be considered to be conventional and, for that reason, no details of the construction have been illustrated.

In accordance with the invention, the engine 13 is provided with a separate lubricating system that consists of a lubricant delivery tank, indicated generally by the reference numeral 23, and which is supported within the outer cowling 12 in proximity to the engine 13. Lubricant from the tank 23 is delivered to the engine 13 for its lubrication in any of a variety of manners. For example, the lubricant from the tank 23 may be introduced to the engine by spraying it into the induction system under pressure from an engine driven pump. Alternatively, the lubricant may be delivered to the fuel line for mixture with the fuel before introduction to the carburetors of the engine. Any of these or other well known separate lubricating systems may be used in conjuction with the invention.

Figure 2:
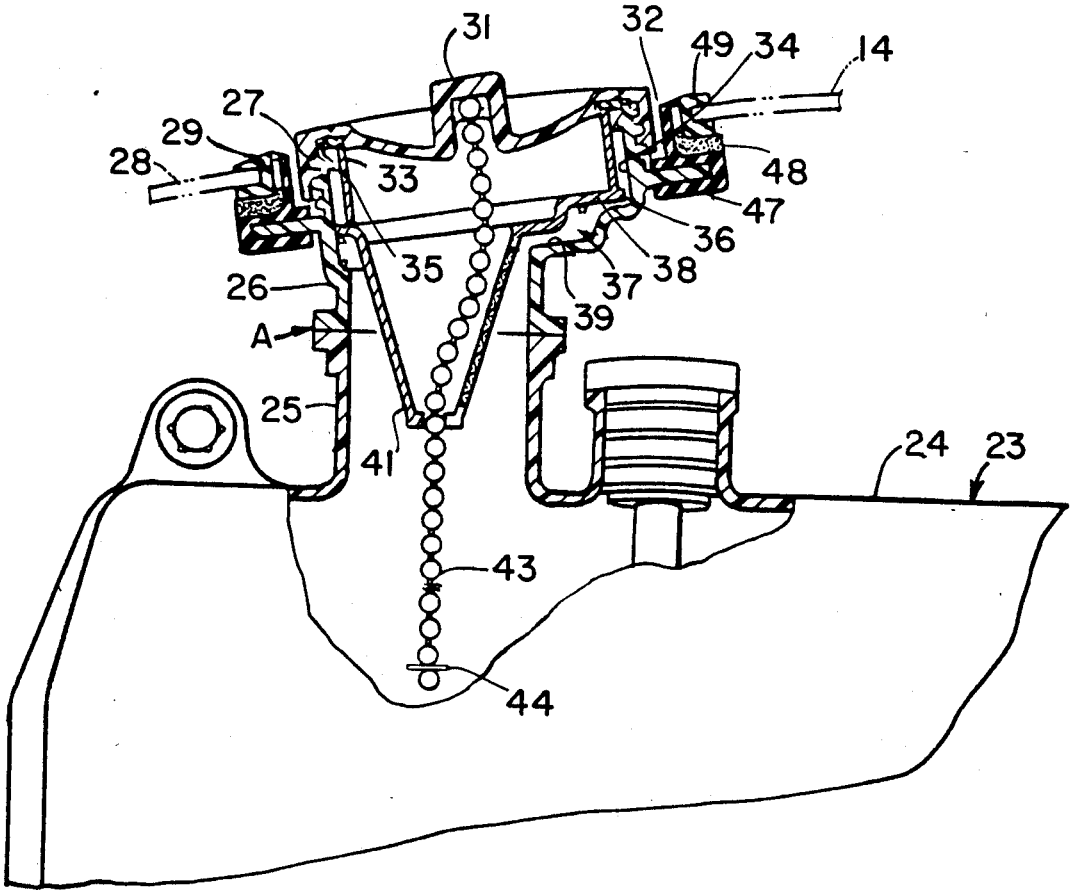
FIG. 2 is an enlarged view, with a portion broken away, showing the relationship between the outer cowling and lubricant tank filler neck with the closure cap in a closed position.
Figure 3:
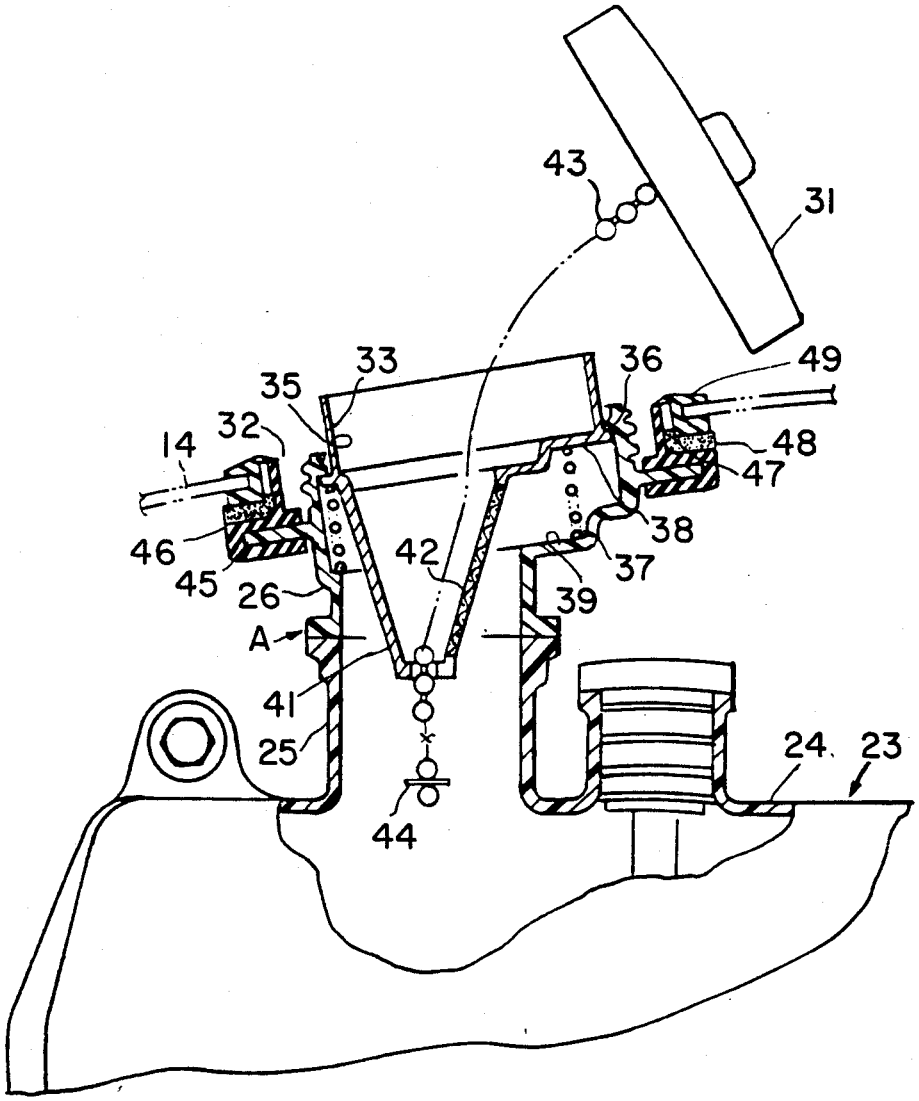
FIG. 3 is a view, in part similar to FIG. 2, showing the closure cap removed.

The invention relates to the filling arrangement for the lubricant tank 23 and specifically its relationship to the outer cowling member 14 which may be best understood by reference to FIGS. 2 and 3. The lubricant tank 23 has a main body portion 24 which may be formed from a molded plastic or the like and which has an upstanding filler neck 25 that defines a fill opening. In accordance with the invention, a filler neck extension, indicated generally by the reference numeral 26, has a lower flange which is affixed in a suitable manner to a corresponding flange of the filler neck 25, as by sonic welding, adhesive bonding, solvent welding or the like along a joint indicated by the line A.

The neck extension 26 has an externally threaded upper part 27 that terminates substantially flush with an upper surface 28 of the cowling member 14. The surface 28 is formed with an opening 29 so as to allow access to a closure cap 31 that is threaded onto the threads 27 and which is substantially flush with the cowling surface 28. An annular gap 32 is formed that allows access to the cap 31 so that it can be inserted or removed.

Since the upper end of the filler neck extension 27 is substantially flush with the cowling 28, it is desirable to provide an arrangement so as to facilitate filling. To this end, a sleeve 33 is slidably supported within a cylindrical opening 34 of the filler neck extension 27. The sleeve 33 has a generally cylindrical portion 35 that terminates at its lower end in an outstanding flange 36 that is substantially coextensive with the opening 34 of the filler neck extension 27. A coil compression spring 37 engages a surface 38 formed on the other side of the flange 36 and a shoulder 39 formed at the base of the filler neck opening 34 so as to normally urge the sleeve 33 upwardly. When the cap 31 is in place, it will engage the upper end of the sleeve 33 and force it downwardly to a retracted position as shown in FIG. 2. When the cap 31 is removed, the spring 37 will urge the sleeve 33 upwardly so that it will be positioned a substantial distance above the cowling surface 28. An inwardly extending flange at the upper end of the filler neck extension 26 will engage the upper side of the flange 36 so as to limit the degree of upward movement and also so as to retain the sleeve 33 within the filler neck extension 26.

The flange 36 and specifically its lower surface 38 has a depending funnel shaped member 41 in which screened openings 42 are provided so that lubricant poured into the sleeve opening 35 may enter the tank 23 and, at the same time, foreign matter will be removed from it.

The cap 31 is retained relative to the sleeve 33 by means of a chain or the like 43 that has a fastener 44 received within an appropriately shaped opening at the lower end of the funnel shaped portion 41 so as to retain the cap 31 relative to the tank 23 even when it is opened.

An arrangement is provided for insuring an effective seal between the cowling member 14 and the filler neck extension 26 so that foreign materials cannot enter into the interior of the cowling 14 even though the gap 32 is provided for affording access to the cap 31. This sealing arrangement is comprised of an outwardly extending flange 45 that is formed integrally with the neck extension 26 and which extends radially outwardly beyond the opening 29. An elastic seal 46 is received around and upon the flange 45 and has an upwardly extending portion 47 that extends into the gap 32 but which is spaced radially inwardly from the opening 29. An annular ring of more resilient sealing material 48 rests upon the seal 46 and encircles the portion 47. This seal 48 is engaged by a similar more rigid sealing member 49 which is fitted onto the cowling member 28 around the opening 29. Hence, an effective seal is provided and yet the cowling member 14 may be removed without necessitating removal of the tank 23 or the filler neck extension 26. The construction of this seal readily accommodates vibrations and misalignment, as should be readily apparent.

Figure 4:
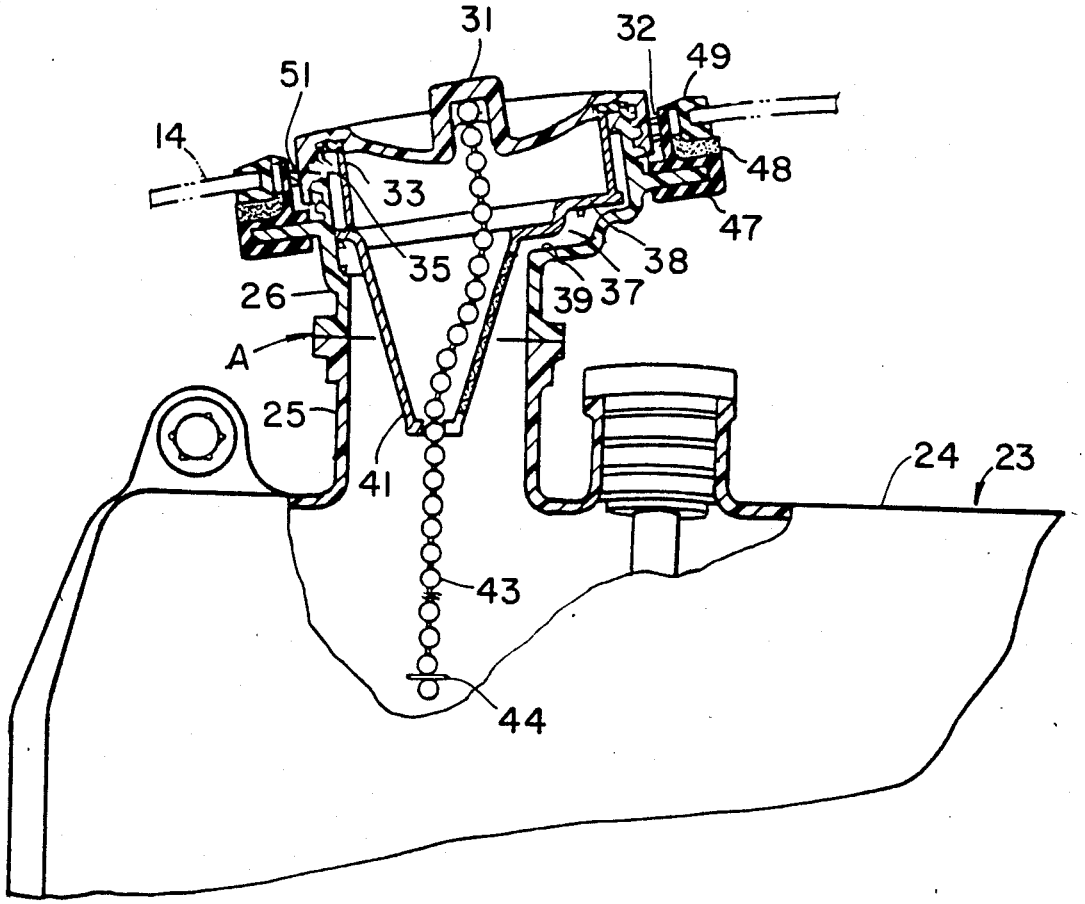
FIG. 4 is a view, in part similar to FIG. 2, and shows a further embodiment of the invention.

FIG. 4 shows another embodiment of the invention which is substantially the same as the embodiment of FIGS. 1 through 3, but which embodies a still further arrangement for insuring good sealing. In accordance with this embodiment of the invention, the cowling seal 49 is provided with inwardly extending radial ribs 51 that are adapted to engage and seal the cap 31 below its upper end. The ribs 51 provide effective sealing but do not interfere with the access to or removal and insertion of the closure cap 31.

It should be readily apparent that the described construction provides a separate fluid tank within the outer cowling of an outboard motor which can be effectively sealed, which is substantially flush with the outer cowling and which also incorporates an arrangement for facilitating filling. Although two embodiments of the invention have been illustrated and described, various changes and modifications may be made without departing from the spirit and scope of the invention, as defined by the appended claims.

I claim:

1. An outboard motor having a power head containing an internal combustion engine, a protective cowling as a part of said outboard motor encircling said engine and defining an opening, a fluid tank contained within said protective cowling and having a filler neck terminating contiguous to said opening and substantially flush with an outer surface of said protective cowling, a cap having a screw type connection to said filler neck to be detachably affixed to said filler neck, a sleeve slidably supported within said neck in an axial direction relative to said filler neck between a retracted position in which said sleeve does not extend substantially beyond said protective cowling and an extended position in which the outer end of said sleeve extends substantially beyond said protective cowling to assist in filling said tank, means for retaining said sleeve relative to said neck for movement between said positions, said sleeve being engageable by said cap when said cap is reinstalled on said filler neck in an axial direction for returning said sleeve from its extended position back to its retracted position, and sealing means engaged with said filler neck around its periphery and with said protective cowling for precluding entry of foreign matter into said protective cowling through said opening.

2. An outboard motor as set forth in claim 1 further including biasing means for urging said sleeve to the extended position.

3. An outboard motor as set forth in claim 2 wherein the neck defines a cylindrical recess in which the sleeve is slidably supported and the neck has an inwardly extending flange adapted to engage an outwardly extending flange on the sleeve for providing the means for retaining the sleeve relative to the neck.

4. An outboard motor as set forth in claim 3 wherein the sleeve terminates at its lower end in a funnel shaped filling portion having strainer means.

5. An outboard motor as set forth in claim 3 further including biasing means for urging the sleeve to its extended position, said cap being adapted to engage said sleeve when inserted on the neck and urge said sleeve from its extended position to its retracted position.

6. An outboard motor as set forth in claim 5 further including a flexible transmitter interconnecting the cap with the sleeve for retaining the cap relative to the tank.

7. An outboard motor as set forth in claim 1 wherein the sealing means further includes means for sealing engaging the periphery of a closure cap received on the filler neck.

* * * * *